US006780833B1

(12) United States Patent
Hayashi et al.

(10) Patent No.: US 6,780,833 B1
(45) Date of Patent: Aug. 24, 2004

(54) SOFTENER COMPOSITION

(75) Inventors: Hiromitsu Hayashi, Wakayama (JP); Noriko Yamaguchi, Wakayama (JP); Shuji Tagata, Wakayama (JP); Ikuo Sugano, Wakayama (JP)

(73) Assignee: Kao Corporation, Tokyo (JP)

( * ) Notice: Subject to any disclaimer, the term of this patent is extended or adjusted under 35 U.S.C. 154(b) by 121 days.

(21) Appl. No.: 09/868,920

(22) PCT Filed: Nov. 9, 2000

(86) PCT No.: PCT/JP00/07897

§ 371 (c)(1),
(2), (4) Date: Jul. 25, 2001

(87) PCT Pub. No.: WO01/36737

PCT Pub. Date: May 25, 2001

(30) Foreign Application Priority Data

| | | |
|---|---|---|
| Nov. 12, 1999 | (JP) | 11-323180 |
| Apr. 4, 2000 | (JP) | 2000-102428 |
| Apr. 14, 2000 | (JP) | 2000-114098 |

(51) Int. Cl.[7] ..... C11D 1/645
(52) U.S. Cl. ..... 510/515
(58) Field of Search ..... 510/515

(56) References Cited

U.S. PATENT DOCUMENTS

| | | | | |
|---|---|---|---|---|
| 5,399,272 A | | 3/1995 | Swartley et al. | |
| 5,686,376 A | * | 11/1997 | Rusche et al. | 502/329 |
| 6,277,796 B1 | * | 8/2001 | Sivik et al. | 510/101 |

FOREIGN PATENT DOCUMENTS

| | | |
|---|---|---|
| EP | 0 022 555 | 7/1980 |
| JP | 3-287867 | 12/1991 |
| JP | 5-098571 | 4/1993 |

(List continued on next page.)

*Primary Examiner*—John R. Hardee
(74) *Attorney, Agent, or Firm*—Oblon, Spivak, McClelland, Maier & Neustadt, P.C.

(57) ABSTRACT

The purpose of the present invention is to provide a softener composition which suppresses for a long time body smell derived from sweat etc. and is excellent in the softening effect. That is, the present invention relates to a softener composition comprising:

(a) a quaternary ammonium compound represented by the formula (1):

(1)

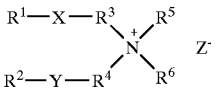

wherein $R^1$ and $R^2$ independently represent a $C_{12-22}$ alkyl or alkenyl group, X and Y are independently —COO—, —CONR$^7$—, —OCO— or —NR$^7$CO—, provided that at least one of X and Y is —COO— or —OCO—, $R^7$ represents a hydrogen atom or a $C_{1-3}$ alkyl or hydroxyalkyl group, $R^3$ and $R^4$ independently represent a $C_{1-5}$ alkylene group, $R^5$ and $R^6$ represent a $C_{1-3}$ alkyl or hydroxyalkyl group or $R^1$—X—$R^3$— and $Z^-$ is an anionic group, (b) a quaternary ammonium compound represented by the formula (2):

(2)

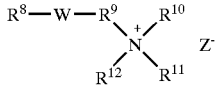

wherein $R^8$ represents a $C_{12-22}$ alkyl or alkenyl group, W is a group selected from —COO—, —CONR$^7$—, —OCO— and —NR$^7$CO—, $R^7$ represents a hydrogen atom or a $C_{1-3}$ alkyl or hydroxyalkyl group, preferably a hydrogen atom, $R^9$ represents a $C_{1-5}$ alkylene group, $R^{10}$ and $R^{11}$ represent a $C_{1-3}$ alkyl or hydroxyalkyl group, $R^{12}$ represents a $C_{1-3}$ alkyl group or —$R^{26}$—OH, $R^{26}$ is a $C_{1-5}$ alkylene group and $Z^-$ is an anionic group, and a compound selected from the following component (c) or (d):

(c) 0.1 to 15% by weight of a compound represented by the formula (3) and/or formula (4):

(3)

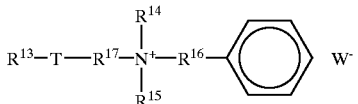

(4)

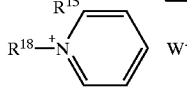

wherein $R^{13}$and $R^{18}$ independently represent a $C_{5-19}$ alkyl or alkenyl group, $R^{14}$ and $R^{15}$ independently represent a $C_{1-3}$ alkyl or hydroxyalkyl group and T is —COO—, —OCO—, —CONH—, —NHCO—,

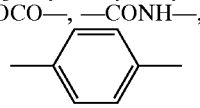

or a linkage, $R^{16}$ represents a $C_{1-3}$ alkylene group, $R^{17}$ represents a $C^{1-6}$ alkylene group or —(O—$R^{19}$)$_n$—, $R^{19}$ is ethylene group or propylene group and n is a number of 1 to 10 and $W^-$ is an anionic group, and (d) 0.01 to 15% by weight of a compound represented by the formula (5):

(5)

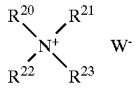

wherein 2 or 3 groups out of $R^{20}$, $R^{21}$, $R^{22}$ and $R^{23}$ represent a $C_{8-12}$, alkyl group, the remainder of them represent a $C_{1-3}$ alkyl group, a $C_{1-3}$ hydroxyalkyl group or a $C_{7-15}$ arylalkyl group and $Z^-$ is an anionic group.

17 Claims, No Drawings

FOREIGN PATENT DOCUMENTS

| | | |
|---|---|---|
| JP | 7-003649 | 1/1995 |
| JP | 9-137379 | 5/1997 |
| JP | 10-512015 | 11/1998 |
| JP | 11-061640 | 3/1999 |
| WO | WO 94/20597 | 9/1994 |
| WO | WO 9856886 | 12/1998 |

* cited by examiner

SOFTENER COMPOSITION

TECHNICAL FIELD

The present invention relates to a softener composition.

BACKGROUND ART

Heretofore, quaternary ammonium salts having long-chain alkyl group, acid salts of tertiary amines, etc. have been used for softeners. Further, compounding of a softener composition with an antimicrobial agent has been attempted for sanitation and deodorization of fiber products. JP-A 10-512015 discloses a softener composition comprising a water-insoluble quaternary ammonium salt as a softener and a water-soluble quaternary ammonium salt as an antimicrobial agent compounded therein. In addition, JP-A 7-3649 discloses a fiber product-softener composition, having pH 2 to 5, comprising a di-long-chain-alkyl amine ($C_{6-24}$ alkyl or alkenyl group which may be interrupted by an ether linkage, ester linkage or acid amide linkage) and a mono-long-chain-alkyl quaternary ammonium salt ($C_{6-24}$ alkyl or alkenyl group which may be interrupted by an ether linkage, ester linkage or acid amide linkage), at a weight ratio of from 9:1 to 5:5. WO 98/56886 discloses an antimicrobial fiber softener composition, being suitable for conferring antimicrobial performance on fibers, comprising a conventional fiber softener composition and one or more cationic antimicrobial agents in a larger amount than required for antimicrobial performance. It, however, is a problem that the antimicrobial water-soluble quaternary ammonium salt lowers the softening effect. The softening effect is necessarily sacrificed in order to attain a satisfactory antimicrobial effect. In particular, it is difficult to achieve a composition demonstrating both a high softening effect and antimicrobial performance being capable of suppressing for long nasty smell attributable to microorganisms when clothes are dried in a room and body smell derived from sweat at the time of wearing.

DISCLOSURE OF INVENTION

Accordingly, the purpose of the present invention is to provide a softener composition which suppresses for long body smell derived from sweat etc. and is excellent in the softening effect.

The present invention relates to a softener composition comprising:

(a) a quaternary ammonium compound represented by the formula (1)

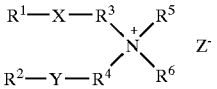

wherein $R^1$ and $R^2$ independently represent a $C_{12-22}$ alkyl or alkenyl group, X and Y are independently —COO—, —CONR$^7$—, —OCO— or —NR$^7$CO—, preferably provided that at least one of X and Y is —COO— or —OCO—. $R^7$ represents a hydrogen atom or a $C_{1-3}$ alkyl or hydroxyalkyl group. $R^3$ and $R^4$ independently represent a $C_{1-5}$ alkylene group, $R^5$ and $R^6$ represent a $C_{1-3}$ alkyl or hydroxyalkyl group or $R^1$—X—$R^3$—, and $Z^-$ is an anionic group, (b) a quaternary ammonium compound represented by formula (2):

(2)

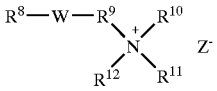

wherein $R^8$ represents a $C_{12-22}$ alkyl or alkenyl group, W is a group selected from —COO—, —CONR$^7$—, —OCO— and —NR$^7$CO—, $R^7$ represents a hydrogen atom or a $C_{1-3}$ alkyl or hydroxyalkyl group, preferably a hydrogen atom, $R^9$ represents a $C_{1-5}$ alkylene group, $R^{10}$ and $R^{11}$ represent a $C_{1-3}$ alkyl or hydroxyalkyl group, $R^{12}$ represents a $C_{1-3}$ alkyl group or —R$^{26}$—OH, $R^{26}$ is a $C_{1-5}$ alkylene group and $Z^-$ is an anionic group, and a compound selected from the following component (c) or (d):

(c) 0.1 to 15% by weight of a compound represented by formula (3) and/or formula (4):

(3)

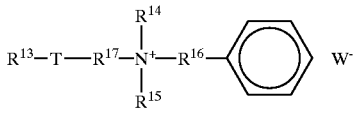

(4)

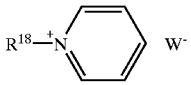

wherein $R^{13}$ and $R^{18}$ independently represent a $C_{5-19}$ alkyl or alkenyl group, $R^{14}$ and $R^{15}$ independently represent a $C_{1-3}$ alkyl or hydroxyalkyl group, and T is —COO—, —OCO—, —CONH—, —NHCO—,

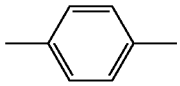

or a linkage; $R^{16}$ represents a $C_{1-3}$ alkylene group, $R^{17}$ represents a $C_{1-6}$ alkylene group or —(O—R$^{19}$)$_n$, $R^{19}$ is ethylene group or propylene group and n is a number of 1 to 10 and $W^-$ is an anionic group, and (d) 0.01 to 15% by weight, preferably 0.1 to 15% by weight of a compound represented by formula (5):

(5)

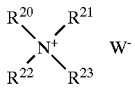

wherein 2 or 3 groups of $R^{20}$, $R^{21}$, $R^{22}$ and $R^{23}$ represent a $C_{8-12}$ alkyl group while the remainder(s) represents a $C_{1-3}$ alky group, $C_{1-3}$ hydroxyalkyl group or $C_{7-15}$ arylalkyl group, and $Z^-$ is an anionic group.

As used herein, the "linkage" refers to a covalent bond directly linking $R^{13}$ with $R^{17}$.

BEST MODE FOR CARRYING OUT THE INVENTION

The component (a) of the present invention is a compound having the formula (1):

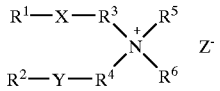

(1)

in which $R^1$ and $R^2$ independently represent a $C_{12-22}$, preferably $C_{14-22}$ and more preferably $C_{14-18}$ alkyl or alkenyl group, X and Y independently represent a group selected from —COO—, —CONR$^7$—, —OCO— and —NR$^7$CO—, and preferably at least one of X and Y is —COO— or —OCO—; X and Y are preferably —COO— or —OCNR$^7$—. $R^7$ represents a hydrogen atom or a $C_{1-3}$ alkyl or hydroxyalkyl group. $R^3$ and $R^4$ independently represent a $C_{1-5}$ alkylene group, $R^5$ and $R^6$ represent a $C_{1-3}$ alkyl or hydroxyalkyl group or $R^2$—X—$R^3$—, and $Z^-$ is an anionic group. $Z^-$ is preferably a halogen ion, sulfate ion, phosphate ion, a $C_{1-3}$ alkyl sulfate ion or a $C_{1-12}$ fatty acid ion.

The component (a) is particularly preferably the following compound.

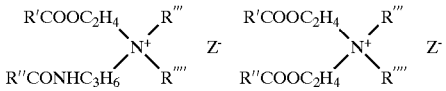

R' and R" may be the same as or different from each other and represent a $C_{12-18}$ alkyl or alkenyl group; R''' is a $C_{1-3}$ alkyl or hydroxyalkyl group; and R'''' is a $C_{1-3}$ alkyl group.

The component (b) of the present invention is a compound represented by formula (2):

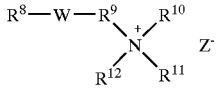

(2)

wherein $R^8$ represents a $C_{12-22}$, preferably $C_{14-22}$ and more preferably $C_{14-18}$ alkyl or alkenyl group, W is —COO—, —CONR$^7$—, —OCO— or —NR$^7$CO—, preferably —COO— or —OCNR$^7$—. $R^7$ represents a hydrogen atom or a $C_{1-3}$ alkyl or hydroxyalkyl group, preferably a hydrogen atom. $R^9$ is a $C_{1-5}$ alkylene group and $R^{10}$ and $R^{11}$ independently represent a $C_{1-3}$ alkyl or hydroxyalkyl group. $R^{12}$ is a $C_{1-3}$ alkyl group or —$R^{26}$—OH. $R^{26}$ is a $C_{1-5}$ alkylene group. $Z^-$ is an anionic group, preferably a halogen ion, a fatty acid ion or a $C_{1-3}$ alkyl sulfate ion.

The component (c) of the present invention is a compound of the formula (3) or (4) above shown. As the most preferable component (c), the following compounds can be exemplified. In the formulae, $Z^-$ has the meanings as defined above.

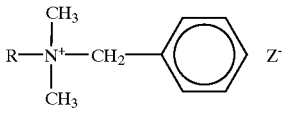

(R is a $C_{12-16}$ alkyl group.)

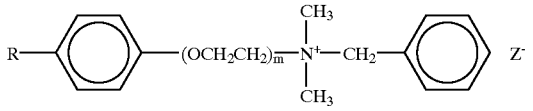

(R is an optionally branched $C_{6-10}$ alkyl group and m is an integer of 1 to 5.)

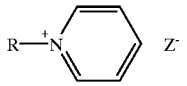

(R is a $C_{8-18}$ alkyl group.)

The component (d) of the present invention is a compound of the formula (5) above shown and the anionic group represented by W of the formula (5) is preferably a sulfate ion, a halogen ion, a $C_{1-12}$ fatty acid ion or a $C_{1-3}$ alkyl sulfate ion.

(Softener Composition)

The softener composition of the present invention comprises the component (a) in an amount of preferably 3 to 50% by weight, more preferably 3 to 40% by weight and particularly preferably 5 to 35% by weight. Further, the amount of the component (b) is 0.5 to 10% by weight, preferably 0.5 to 5% by weight. In addition, it is preferable to the softening effect and the deodorizing effect that a weight ratio of the component (a)/the component (b) is from 80/20 to 99/1, particularly from 85/15 to 95/1.

When the component (c) is used in the present invention, the component (c) is contained in an amount of 0.1 to 15% by weight, preferably 1 to 15% by weight and particularly preferably 3 to 10% by weight. Further, it is desirable to the feeling in touch of clothes and the deodorizing effect that the ratio of (c)/(a) by weight is from 1/30 to 1/1, preferably from 1/10 to 1/1. Further, when the component (d) is used in the present invention, it is desirable to the feeling in touch of clothes and the deodorizing effect that the amount of the component (d) is preferably 0.1 to 15% by weight, more preferably 0.2 to 10% by weight, and a weight ratio of (a)/(d) is from 50/1 to 2/1, preferably from 30/1 to 2/1, and more preferably from 20/1 to 2/1.

The softener composition of the present invention is

The softener composition of the present invention is preferably in the form of an aqueous solution comprising at least the component (a) and the component (b) and the component (c) or (d), diluted in water. The water used is preferably distilled water or deionized water. It is desirable for storage stability that water is incorporated in an amount of 40 to 90% by weight, more preferably 50 to 80% by weight and particularly preferably 60 to 85% by weight into the composition.

Further, it is preferable to the deodorizing effect and for storage stability that the composition of the present invention is adjusted to a pH value of 1 to 6, further 2 to 5, and particularly 2.5 to 4 at 20° C.

In the present invention, incorporation of a nonionic surfactant (e) in addition to the above components (a), (b), (c) and (d) is preferable for storage stability. The nonionic surfactant is preferably a polyoxyethylene alkyl ether containing one or more $C_{8-20}$ alkyl or alkenyl group, particularly preferably a nonionic surfactant of the formula (6):

$$R^{24}—U—[(R^{25}O)_p—H]_q \quad (6)$$

wherein $R^{24}$ is a $C_{10-18}$, preferably $C_{12-18}$, alkyl or alkenyl group, $R^{25}$ is a $C_2$ or $C_3$ alkylene group, preferably an ethylene group; p is an integer of 2 to 100, preferably 5 to 80, more preferably 10 to 80 and particularly preferably 20 to 60; and U is —O—, —CON— or —N—, and when U is —O—, q is 1, and when U is —CON— or —N—, q is 2.

The compound of the formula (6) includes for example the following compounds:

$$R^{24}—O—(C_2H_4O)r—H$$

wherein $R^{24}$ has the same meanings as defined above; and when the component (c) is contained, r is an integer of 8 to 100, and when the component (d) is contained, r is an integer of 5 to 100, preferably 10 to 80 and more preferably 20 to 80.

$$R^{24}—O—(C_2H_4O)s(C_3H_6O)t—H$$

wherein $R^{24}$ has the same meanings as defined above; s and t are independently an integer of 2 to 40, preferably 5 to 40, and the sum of s and t is preferably an integer of 10 to 80, and the ethylene oxide and propylene oxide units may be a random- or block-addition product.

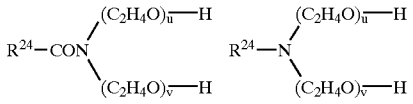

wherein $R^{24}$ has the same meanings as defined above; and when the component (c) is contained, the sum in total of u and v is an integer of 5 to 100 and when the component (d) is contained, the sum in total thereof is an integer of 10 to 80, preferably 5 to 80.

From the viewpoint of stability, the amount of the nonionic surfactant incorporated is 0.5 to 10% by weight, preferably 1 to 8% by weight.

For the purpose of improving the feeling in touch of fiber products, in the present invention, (f) a $C_{8-22}$ fatty acid or a salt thereof is preferably added in an amount of 0.1 to 5% by weight, particularly 0.5 to 3% by weight.

The fatty acid or a salt thereof includes caprylic acid, capric acid, lauric acid, myristic acid, palmitic acid, stearic acid, oleic acid or a mixture thereof. One or more members selected from lauric acid, stearic acid and oleic acid are particularly preferable. Further, fatty acids having an alkyl composition derived from coconut oil, palm oil, palm seed oil or tallow are also preferable.

In the present invention, it is preferable for storage stability that an ester compound of a $C_{8-22}$ saturated or unsaturated fatty acid and a polyvalent alcohol is incorporated in an amount of 0.1 to 10% by weight, particularly 0.5 to 5% by weight into the composition. The ester compound is preferably triglycerides, diglycerides, monoglyceride, a mono-, di- or tri-ester of pentaerythritol and sorbitan ester.

In the present invention, it is desirable for storage stability that inorganic salts such as calcium chloride are added in an amount of 0 to 1000 ppm, preferably 1 to 1000 ppm, and more preferably 10 to 500 ppm. Sodium salts and potassium salts are contained in surfactants such as fatty acid salts and the inorganic salts mixed in the composition by using such surfactants are not subject to the above limitation.

In the present invention, a solvent component selected from ethanol, isopropanol, glycerin, ethylene glycol, propylene glycol, diethylene glycol, dipropylene glycol and polyoxyethylene phenyl ether is further preferably incorporated for storage stability. These solvent components are incorporated in an amount of preferably 0 to 20% by weight, more preferably 0.1 to 20% by weight and particularly preferably 0.5 to 10% by weight into the composition. If ethanol is used, it is desirable to use a polyoxyethylene alkyl ether sulfate-modified ethanol or an 8-acetylated sucrose-modified ethanol.

Ingredients such as silicone being ordinarily incorporated into a fiber-treating agent, a perfume (particularly preferably a combination of aroma components shown as the components (c) and (d) described in JP-A 8-113871) and a coloring matter may be incorporated into the softener composition of the present invention.

EXAMPLES

<Compounding Ingredients>

The ingredients used in the present invention are shown below.

(a-1)

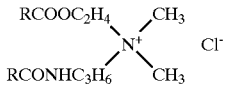

R: a mixed $C_{18}$ and $C_{16}$ saturated alkyl group (ratio by weight of $C_{18}$ group/$C_{16}$ group=60/40)

(a-2)

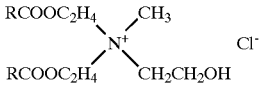

R: a mixed $C_{18}$ and $C_{16}$ saturated alkyl group (ratio by weight of $C_{18}$ group/$C_{16}$ group=60/40)

(a-3)

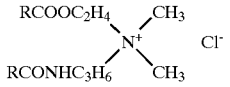

R: a mixed $C_{17}$ and $C_{15}$ saturated alkyl group (ratio by weight of $C_{17}$ group/$C_{15}$ group=60/40)

(a-4)

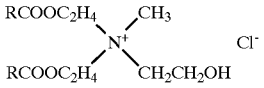

R: a mixed $C_{17}$ and $C_{15}$ saturated alkyl group (ratio by weight of $C_{17}$ group/$C_{15}$ group=60/40)

(a-5) Di(oleoyl oxyethyl)dimethyl ammonium methyl sulfate.

(a-6)

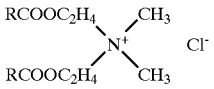

R: a mixed $C_{17}$ and $C_{15}$ saturated alkyl group (ratio by weight of $C_{17}$ group/$C_{15}$ group=60/40)

(a'-1) Dioleyl dimethyl ammonium chloride.

(b-1)

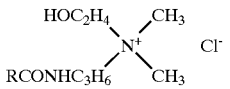

R: a mixed $C_{18}$ and $C_{16}$ saturated alkyl group (ratio by weight of $C_{18}$ group/$C_{16}$ group=60/40)

(b-2)

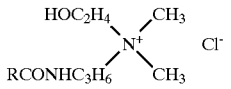

R: a mixed $C_{17}$ and $C_{15}$ saturated alkyl group (ratio by weight of $C_{17}$ group/$C_{15}$ group=60/40)

(c-1)

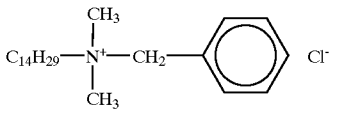

(c-2)

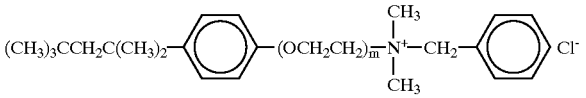

(c-3)

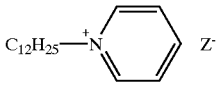

(d-1) Didecyl dimethyl ammonium chloride.

(e-1) An addition product of a saturated alcohol containing 12 carbon atoms to which 21 moles on the average of ethylene oxide have been added.

(e-2) An addition product of lauric acid diethanolamide to which 20 moles on the average of ethylene oxide have been added.

(f-1) Lunack™ S-50 (stearic acid produced by Kao Corporation).

(f-2) Lauric acid.

(f-3) Myristic acid.

(f-4) Palmitic acid.

(g-1) Excel™ 150 [a mixture of stearic mono-, di- and triglycerides (mono:di:tri=60:35:5) produced by Kao Corporation].

(g-2) Calcium chloride.

(g-3) Ethylene glycol.

(h-1) Coloring matter (Acid blue 9).

(h-2) Perfume [a mixture of hexyl cinnamic aldehyde (18), nerolin yarayara (4), tricyclodecenyl acetate (4), benzyl acetate (10), musk ketone (5), anisyl acetone (2), sandal mysolcore (2), aldehyde C14 peach (1), linalool (18), dihydroxy myrcenol (8), borneol (4), cedrol (4), mugoal (5), benzyl alcohol (5) and dipropylene glycol (10), the figures shown in the parentheses meaning a percent by weight in the perfume mixture.].

(h-3) Silicone (TSA730 produced by Toshiba Silicone Co., Ltd.).

Example 1

Using the above compounds, the softener compositions shown in Table 1 were prepared (invention products 1 to 6 and comparative products 1 to 3). Two sweaters (100% cotton) were washed using a commercial weakly alkaline detergent (Attack™, Kao Corporation) in a laundering machine (two-tank system laundering machine VH-360S1 manufactured by Toshiba Corp.; detergent concentration, 0.0667% by weight; 30 L tap water used; water temperature of 20° C.; 10 minutes). Thereafter, the washing water was discharged and the clothes were dehydrated for 1 minute. After 30 L tap water was poured into the tank, the clothes were rinsed for 5 minutes, the water was discharged, and the clothes were dehydrated for 1 minute. Then, 30 L tap water was again poured into the tank, and 5 g of each softener composition of Table 1 was added thereto. It was stirred for 5 minutes. Thereafter, the clothes were dehydrated and dried for 12 hours in a thermostatic chamber at 70% RH at 25° C.

(Evaluation of Softening Performance)

The softener compositions of Table 1 and the corresponding compositions to them, except that the antimicrobial component, the component (c) or (d), was not added, were used in the softening treatment described above. They were evaluated in a paired comparison test using the following criteria by a panel of 10 persons to determine a mean value.

+1: Finished to be the softer in the presence of component (c) or (d).

0: No difference in finish regardless of the presence or absence of the component (c) or (d).

−1: Finished to be the softer in the absence of the component (c) or (d).

(Evaluation of Smell)

The smell of the clothes dried in a thermostatic chamber and the smell of the same clothes worn for 12 hours by 5 males, aged twenties, were judged using the following criteria by a panel of 10 persons (10 males aged thirties), to determine a mean value.

0: Hardly smelled.

1: Slightly smelled but not annoying.

2: Smelled.

3: Significantly smelled.

TABLE 1

| | Product of the present Invention | | | | | | Comparative Product | | | |
|---|---|---|---|---|---|---|---|---|---|---|
| | 1 | 2 | 3 | 4 | 5 | 6 | 1 | 2 | 3 | 4 |
| Softener Composition | | | | | | | | | | |
| Component (wt %) | | | | | | | | | | |
| (a-1) | 15 | | 6 | | | | | | | 15 |
| (a-2) | | 15 | | | | | | | | |
| (a-3) | | | | 15 | | 6 | | | | |
| (a-4) | | | | | 15 | | | | | |
| (a-5) | | | | | | | 15 | 15 | 7.5 | |
| (c-1) | 5 | | | 5 | | | 5 | | | 5 |

TABLE 1-continued

| | Product of the present Invention | | | | | | Comparative Product | | | |
|---|---|---|---|---|---|---|---|---|---|---|
| | 1 | 2 | 3 | 4 | 5 | 6 | 1 | 2 | 3 | 4 |
| (c-2) | | 5 | | | 5 | | | | | |
| (c-3) | | | 3 | | | 3 | | | | |
| (d-1) | | | | | | | | 5 | 10 | |
| (e-1) | 2 | | 2 | 2 | | 2 | 2 | 2 | 2 | 2 |
| (e-2) | | 2 | | | 2 | | | | | |
| (f-1) | 1 | 1 | 1 | 1 | 1 | 1 | 1 | 1 | 1 | 1 |
| (g-1) | 1 | 1 | 1 | 1 | 1 | 1 | 1 | 1 | 1 | 1 |
| (g-2) | 100 ppm | 100 ppm | 100 ppm | 100 ppm | 100 ppm | 100 ppm | 100 ppm | 100 ppm | 100 ppm | 100 ppm |
| (g-3) | 3 | 3 | 3 | 3 | 3 | 3 | 3 | 3 | | 3 |
| (b-1) | 1.5 | 1.5 | 0.5 | | | | | | | |
| (b-2) | | | | 1.5 | 1.5 | 0.5 | | | | |
| (h-1) | 10 ppm | 10 ppm | 10 ppm | 10 ppm | 10 ppm | 10 ppm | 10 ppm | 10 ppm | 10 ppm | 10 ppm |
| (h-2) | 50 ppm | 50 ppm | 50 ppm | 50 ppm | 50 ppm | 50 ppm | 50 ppm | 50 ppm | 50 ppm | 50 ppm |
| (h-3) | 0.1 | 0.1 | 0.1 | 0.1 | 0.1 | 0.1 | 0.1 | 0.1 | | 0.1 |
| deionized water | balance | ← | ← | ← | ← | ← | ← | ← | ← | ← |
| Total | 100 | 100 | 100 | 100 | 100 | 100 | 100 | 100 | 100 | 100 |
| pH (20° C.) | 3.5 | 3.5 | 3.5 | 3.5 | 3.5 | 3.5 | 3.5 | 3.5 | 1 | 3.5 |
| Smell | | | | | | | | | | |
| Clothes after drying | 0.6 | 0.4 | 0.6 | 0.6 | 0.4 | 0.6 | 1.3 | 1.4 | 1.5 | 1.2 |
| Clothes after worn | 1.1 | 1 | 1.2 | 1.1 | 1 | 1.2 | 1.4 | 1.7 | 1.7 | 1.5 |
| Softening Performance | 0.2 | 0.1 | 0.1 | 0.2 | 0.1 | 0.1 | −0.3 | −0.4 | −0.5 | −0.2 |

*pH was obtained by adjustment with 0.1N aqueous sulfuric acid or 0.1N sodium hydroxide solution.

Example 2

The softener compositions (invention products 7 to 11) shown in Table 2 were prepared in the same manner as in Example 1.As the perfume, a mixture of 100 parts by weight of a composition of Table 3 and 10 parts by weight of dipropylene glycol was used. These softener compositions were evaluated in the same manner as in Example 1. As results they were all recognized to exhibit an excellent smell-preventing effect and softening performance.

TABLE 3

| Perfume Ingredient (wt %) | Perfume 1 | Perfume 2 | Perfume 3 | Perfume 4 | Perfume 5 |
|---|---|---|---|---|---|
| hexyl cinnamic aldehyde | 0 | 0 | 13 | 0 | 0 |
| Nerolin yarayara | 0 | 0 | 3 | 0 | 0 |
| tricyclodecenyl acetate | 0 | 0 | 3 | 0 | 0 |
| benzyl acetate | 0 | 0 | 7 | 0 | 0 |

TABLE 2

| | Product of the present Invention | | | | |
|---|---|---|---|---|---|
| | 7 | 8 | 9 | 10 | 11 |
| Softener Composition | | | | | |
| Component (wt %) | | | | | |
| (a-1) | 15 | 15 | | 15 | |
| (a-2) | | | 15 | | 15 |
| (c-1) | 3 | 3 | | 3 | |
| (c-2) | | | 3 | | 3 |
| (e-1) | 2 | 2 | | 2 | |
| (e-2) | | | 2 | | 2 |
| (f-1) | 1 | 1 | 1 | 1 | 1 |
| (g-1) | 1 | 1 | 1 | 1 | 1 |
| (g-2) | 100 ppm | 100 ppm | 100 ppm | 100 ppm | 100 ppm |
| (b-1) | 1.5 | 1.5 | 1.5 | 1.5 | 1.5 |
| (h-1) | 10 ppm | 10 ppm | 10 ppm | 10 ppm | 10 ppm |
| Perfume (described in Table 3) | perfume 1 0.37 | perfume 2 0.25 | perfume 3 0.3 | perfume 4 0.3 | perfume 5 0.3 |
| deionized water | balance | ← | ← | ← | ← |
| Total | 100 | 100 | 100 | 100 | 100 |
| pH (20° C.) | | | | | |
| 3.5 | 3.5 | 3.5 | 3.5 | 3.5 | 3.5 |

*The pH was obtained by adjustment with 0.1N aqueous sulfuric acid or 0.1N sodium hydroxide solution.

TABLE 3-continued

| Perfume Ingredient (wt %) | Perfume 1 | Perfume 2 | Perfume 3 | Perfume 4 | Perfume 5 |
|---|---|---|---|---|---|
| musk ketone | 0 | 0 | 3 | 0 | 0 |
| anisyl acetone | 0 | 0 | 1 | 0 | 0 |
| Sandalmysore core | 0 | 0 | 1 | 0 | 0 |
| Aldehyde C14 peach | 0 | 0 | 1 | 0 | 0 |
| Metyl ionone-γ | 7 | 0 | 0 | 3 | 0 |
| Iso E Super | 7 | 0 | 0 | 3 | 0 |
| Tentarome | 14 | 0 | 0 | 7 | 0 |
| 4-t-butylcyclohexyl-acetate | 14 | 0 | 0 | 7 | 0 |
| Lilial | 20 | 0 | 0 | 10 | 0 |
| Herional | 3 | 0 | 0 | 2 | 0 |
| coumarin | 3 | 0 | 0 | 1 | 0 |
| Ambroxan | 1 | 0 | 0 | 0 | 0 |
| α-Terpinyl acetate | 0 | 12 | 0 | 0 | 20 |
| cedryl acetate | 0 | 8 | 0 | 0 | 13 |
| Lyral | 0 | 8 | 0 | 0 | 13 |
| Pearlide | 0 | 4 | 0 | 0 | 7 |
| Sandal synth | 0 | 4 | 0 | 0 | 7 |
| phenylacetoaldehyde 50% PEA | 0 | 0 | 0 | 0 | 1 |
| aldehyde C12MNA | 0 | 0 | 0 | 0 | 1 |
| cinnamyl cinnamate | 0 | 2 | 0 | 0 | 3 |
| benzyl isoeugenol | 0 | 2 | 0 | 0 | 3 |
| linalool | 0 | 0 | 0 | 0 | 13 |
| dihydromyrcenol | 0 | 0 | 0 | 0 | 7 |
| borneol | 0 | 0 | 0 | 0 | 3 |
| cedrol | 0 | 0 | 0 | 0 | 3 |
| Muguol | 0 | 0 | 0 | 0 | 3 |
| benzyl alcohol | 0 | 0 | 0 | 0 | 3 |
| phenylethyl alcohol | 12 | 0 | 29 | 0 | 0 |
| citronellol | 6 | 0 | 13 | 0 | 0 |
| terpineol | 6 | 0 | 13 | 0 | 0 |
| phenylethyldimethyl carbinol | 3 | 0 | 7 | 0 | 0 |
| styrallyl alcohol | 2 | 0 | 3 | 0 | 0 |
| cinnamic alcohol | 2 | 0 | 3 | 0 | 0 |
| 1-menthol | 0 | 24 | 0 | 27 | 0 |
| geraniol | 0 | 12 | 0 | 13 | 0 |
| dihydromyrcenol | 0 | 12 | 0 | 13 | 0 |
| Phenyl hexanol | 0 | 6 | 0 | 7 | 0 |
| dimethylbenzyl carbinol | 0 | 6 | 0 | 7 | 0 |
| Total (wt %) | 100 | 100 | 100 | 100 | 100 |

Example 3

Using the above compounds, the softener compositions shown in Table 4 were prepared. Five shirts (100% cotton) and 5 towels (100% cotton) (total weight of the clothes: 1.5 kg) were washed using a commercial weakly alkaline detergent (Attack™, Kao Corporation) in a laundry machine (two-tank system laundering machine VH-360S1 manufactured by Toshiba Corp.; detergent concentration, 0.0667% by weight; 30 L tap water used; water temperature of 20° C.; 10 minutes). Thereafter, the washing water was discharged and the clothes were dehydrated for 1 minute. After 30 L tap water was poured into the tank, the clothes were rinsed for 5 minutes, the water was discharged, and the clothes were dehydrated for 1 minute. Then, 30 L tap water was again poured into the tank and 7 ml of each composition of Table 1 was added thereto. It was stirred with the clothes for 5 minutes. Thereafter the clothes were dehydrated and air-dried.

(Evaluation of Deodorizing Effect)

The clothes treated as above were worn for 12 hours by 5 males aged twenties, and the smell generated from the shirts worn were judged using the following criteria by a panel of 10 persons (10 males aged thirties), to determine a mean value. ○ was assigned to a mean value of less than 0.8, □ to a mean value of 0.8 to less than 1.2, Δ to a mean value of 1.2 to less than 1.7, and X to a mean value of 1.7 or more. Results are shown in Table 1.

0: Hardly smelled.
1: Slightly smelled but not annoying.
2: Smelled.
3: Significantly smelled.

(Evaluation of Softness)

The towels treated as above and towels (control) treated in the same way, except for using no composition of Table 4, were judged using the following criteria by a panel of 10 persons (10 males aged thirties), to determine a mean value. ○ was assigned to a mean value of 2 or more, □ to a mean value of 1 to less than 1.5, Δ to a mean value of 0.5 to less than 1, and X to a mean value of less than 0.5. Results are shown in Table 1.

+3: much softer than the control.
+2: Softer than the control.
+1: Slightly softer than the control.
0: Equal to the control.

TABLE 4

| Component | Product of the present Invention | | Comparative Product | |
|---|---|---|---|---|
| (wt %) | 12 | 13 | 5 | 6 |
| Softener Composition | | | | |
| a-3 | 12 | | | 12 |
| a-6 | | 12 | | |
| b-2 | 2 | 2 | | |
| a'-1 | | | 7.5 | |
| d-1 | 3 | 5 | 10 | 1 |
| f-2 | 1 | | | |
| f-4 | | 2 | | |
| e-1 | 5 | | 5 | 5 |
| e-2 | | 5 | | |
| g-2 | 100 ppm | 100 ppm | 100 ppm | 100 ppm |
| h-1 | 10 ppm | 10 ppm | 10 ppm | 10 ppm |
| h-3 | 0.3 | 0.3 | 0.3 | 0.3 |
| pH adjuster and deionized water | balance | ← | ← | ← |
| pH* | 2.5 | 2.5 | 1 | 2.5 |
| Total | 100 wt% | | | |
| (a)/(d) | 4.6/1 | 2.8/1 | 0.75/1 | 12/1 |
| Evaluation of Smell | ○ | ○ | Δ | □ |
| Softening Effect | ○ | ○ | x | □ |

*The pH was obtained by adjustment with 0.1 N aqueous sulfuric acid or 0.1 N sodium hydroxide solution.

What is claimed is:

1. A softener composition comprising:

(a) a quaternary ammonium compound represented by the formula (1):

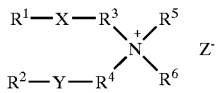

(1)

wherein $R^1$ and $R^2$ independently represent a $C_{12-22}$ alkyl or alkenyl group, X and Y are independently —COO—, —CONR$^7$—, —OCO— or —NR$^7$CO—, provided that at least one of X and Y is —COO— or —OCO—, $R^7$ represents a hydrogen atom or a $C_{1-3}$ alkyl or hydroxyalkyl group, $R^3$ and $R^4$ independently represent a $C_{1-5}$ alkylene group, $R^5$ and $R^6$ represent a $C_{1-3}$ alkyl or hydroxyalkyl group or $R^1$—X—$R^3$— and $Z^-$ is an anionic group, (b) a quaternary ammonium compound represented by the formula (2):

(2)

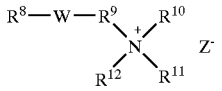

wherein $R^8$ represents a $C_{12-22}$ alkyl or alkenyl group, W is a group selected from —COO—, —CONR$^7$—, —OCO— and NR$^7$CO—, $R^7$ represents a hydrogen atom or a $C_{1-3}$ alkyl or hydroxyalkyl group, —$R^9$ represents a $C_{1-5}$ alkylene group, $R^{10}$ and $R^{11}$ represent a $C_{1-3}$ alkyl or hydroxyalkyl group, $R^{12}$ represents a $C_{1-3}$ alkyl group or —$R^{26}$—OH, $R^{26}$ is a $C_{1-5}$ alkylene group and $Z^-$ is an anionic group, and a compound selected from the following component (c) or (d):

(c) 0.1 to 15% by weight of a compound represented by formula (3) and/or formula (4):

(3)

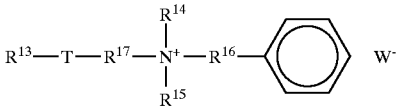

(4)

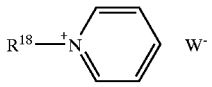

wherein $R^{13}$ and $R^{18}$ independently represent a $C_{5-19}$ alkyl or alkenyl group, $R^{14}$ and $R^{15}$ independently represent a $C_{1-3}$ alkyl or hydroxyalkyl group, and T is —COO—, —OCO—, —CONH—, —NHCO—,

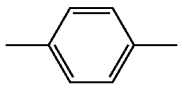

or a linkage, $R^{16}$ represents a $C_{1-3}$ alkylene group, $R^{17}$ represents a $C_{1-6}$ alkylene group or —(O—$R^{19}$)$_n$—, $R^{19}$ is ethylene group or propylene group and n is a number of 1 to 10 and $W^-$ is an anionic group, and (d) 0.01 to 15% by weight of a compound represented by formula (5):

(5)

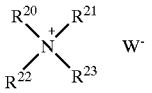

wherein 2 or 3 groups out of $R^{20}$, $R^{21}$, $R^{22}$ and $R^{23}$ represent a $C_{8-12}$ alkyl group, the remainder of them represent a $C_{1-3}$ alkyl group, a $C_{1-3}$ hydroxyalkyl group or a $C_{7-15}$ arylalkyl group and $Z^-$ is an anionic group, which further comprises 0.1 to 5% by weight of (f) a $C_{8-22}$ fatty acid or a salt thereof.

2. The softener composition of claim 1, where $R^7$ is a hydrogen atom.

3. The softener composition of claim 1, which further comprises (e) a nonionic surfactant.

4. The softener composition of claim 1, which comprises 3–50% by weight of component (a).

5. The softener composition of claim 1, which comprises 0.5 to 10% by weight of component (b).

6. The softener composition of claim 1, wherein a weight ratio of component (a)/component (b) is 80/20 to 99/1.

7. The softener composition of claim 1 comprising component (c) in an amount of 0.1 to 15% by weight.

8. The softener composition of claim 1, comprising component (c) in a weight ratio of (c)/(a) of 1/30 to 1/1.

9. The softener composition of claim 1, comprising component (d) in an amount of 0.1 to 15% by weight.

10. The softener composition of claim 1, comprising component (d) in a weight of (a)/(d) of 50/1 to 2/1.

11. The softener composition of claim 1, comprising 40 to 90% by weight of water.

12. The softener composition of claim 1, having a pH value of 1 to 6.

13. The softener composition of claim 1, comprising 0.5 to 10% by weight of said nonionic surfactant.

14. The softener composition of claim 1, further comprising 0 to 1,000 ppm of an inorganic salt.

15. The softener composition of claim 1, further comprising a solvent selected from the group consisting of ethanol, isopropanol, glycerin, ethylene glycol, propylene glycol, diethylene glycol, dipropylene glycol, polyoxyethyene phenyl ether and a mixture thereof.

16. The softener composition of claim 15, wherein said solvent is present in an amount up to 20% by weight.

17. A softener composition comprising:

(a) a quaternary ammonium compound represented by the formula (1):

(1)

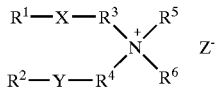

wherein $R^1$ and $R^2$ independently represent a $C_{12-22}$ alkyl or alkenyl group, X and Y are independently —COO—, —CONR$^7$—, —OCO— or —NR$^7$CO—, provided that at least one of X and Y is —COO— or —OCO—, $R^7$ represents a hydrogen atom or a $C_{1-3}$ alkyl or hydroxyalkyl group, $R^3$ and $R^4$ independently represent a $C_{1-5}$ alkylene group, $R^5$ and $R^6$ represent a $C_{1-3}$ alkyl or hydroxyalkyl group or $R^1$—X—$R^3$— and $Z^-$ is an anionic group, (b) a quaternary ammonium compound represented by the formula (2):

(2)

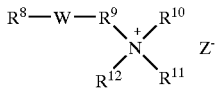

wherein $R^8$ represents a $C_{12-22}$ alkyl or alkenyl group, W is a group selected from —COO—, —CONR$^7$—, —OCO— and NR$^7$CO—, $R^7$ represents a hydrogen atom or a $C_{1-3}$ alkyl or hydroxyalkyl group, —$R^9$ represents a $C_{1-5}$ alkylene group, $R^{10}$ and $R^{11}$ represent a $C_{1-3}$ alkyl or hydroxyalkyl group, $R^{12}$ represents a $C_{1-3}$ alkyl group or —$R^{26}$—OH, $R^{26}$ is a $C_{1-5}$ alkylene group and $Z^-$ is an anionic group, and a compound selected from the following component (c) or (d):

(c) 0.1 to 15% by weight of a compound represented by formula (3) and/or formula (4):

(3)

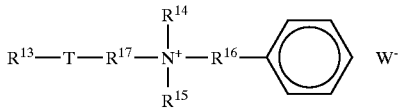

(4)

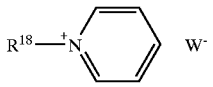

wherein $R^{13}$ and $R^{18}$ independently represent a $C_{5-19}$ alkyl or alkenyl group, $R^{14}$ and $R^{15}$ independently represent a $C_{1-3}$ alkyl or hydroxyalkyl group, and T is —COO—, —OCO—, —CONH—, —NHCO—,

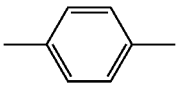

or a linkage, $R^{16}$ represents a $C_{1-3}$ alkylene group, $R^{17}$ represents a $C_{1-6}$ alkylene group or $—(O—R^{19})_n—$, $R^{19}$ is ethylene group or propylene group and n is a number of 1 to 10 and $W^-$ is an anionic group, and (d) 0.01 to 15% by weight of a compound represented by formula (5):

(5)

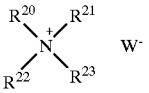

wherein 2 or 3 groups out of $R^{20}$, $R^{21}$, $R^{22}$ and $R^{23}$ represent a $C_{8-12}$ alkyl group, the remainder of them represent a $C_{1-3}$ alkyl group, a $C_{1-3}$ hydroxyalkyl group or a $C_{7-15}$ arylalkyl group and $Z^-$ is an anionic group, which further comprises (e) a nonionic surfactant and 0.1 to 5% by weight of (f) a $C_{8-22}$ fatty acid or salt thereof.

* * * * *

UNITED STATES PATENT AND TRADEMARK OFFICE

CERTIFICATE OF CORRECTION

PATENT NO. : 6,780,833 B1
DATED : August 24, 2004
INVENTOR(S) : Hayashi et al.

It is certified that error appears in the above-identified patent and that said Letters Patent is hereby corrected as shown below:

Title page,
Item [30], Foreign Application Data, should read:

-- Nov. 12, 1999 (JP) ..... 11-323180
Apr. 4, 2000 (JP) ..... 2000-102428
Apr. 14, 2000 (JP) ..... 2000-114097 --

Signed and Sealed this

Fourth Day of January, 2005

JON W. DUDAS
*Director of the United States Patent and Trademark Office*